US005899038A

United States Patent [19]

Stroppiana

[11] Patent Number: 5,899,038

[45] Date of Patent: May 4, 1999

[54] LAMINATED FLOORING, FOR EXAMPLE FOR SPORTS FACILITIES, A SUPPORT FORMATION AND ANCHORING SYSTEMS THEREFOR

[75] Inventor: Fernando Stroppiana, Diano D'Alba, Italy

[73] Assignee: Mondo S.P.A., Italy

[21] Appl. No.: 08/840,605

[22] Filed: Apr. 22, 1997

[51] Int. Cl.[6] ..... E04B 5/02; E04B 5/43; E04F 15/22

[52] U.S. Cl. ..... 52/403.1; 52/480; 52/584.1; 52/591.5

[58] Field of Search ..... 52/403.1, 480, 52/508, 512, 582.2, 583.1, 584.1, 587.1, 586.1, 586.2, 585.1, 591.5, 592.2

[56] References Cited

U.S. PATENT DOCUMENTS

| | | | |
|---|---|---|---|
| 1,425,324 | 8/1922 | Kennedy | 52/586.1 |
| 2,732,706 | 1/1956 | Friedmam | 52/586.1 |
| 4,274,626 | 6/1981 | Grosser et al. . | |
| 4,390,580 | 6/1983 | Donovan et al. | 428/68 |
| 4,694,627 | 9/1987 | Omholt | 52/403.1 X |
| 4,796,392 | 1/1989 | Graham, Jr. | 52/79.5 |
| 4,860,516 | 8/1989 | Koller et al. | 52/480 |
| 4,879,857 | 11/1989 | Peterson et al. | 52/403.1 |
| 5,277,010 | 1/1994 | Stephenson et al. . | |
| 5,299,401 | 4/1994 | Shelton | 52/403.1 |
| 5,303,526 | 4/1994 | Niese | 52/480 X |
| 5,433,052 | 7/1995 | Niese | 52/403.1 |
| 5,540,025 | 7/1996 | Takehara et al. | 52/403.1 |
| 5,595,427 | 1/1997 | Peters et al. | 52/584.1 X |
| 5,618,602 | 4/1997 | Nelson | 52/591.1 X |
| 5,682,724 | 11/1997 | Randjelovic | 52/403.1 |
| 5,713,175 | 2/1998 | Mitchell | 52/582.1 |

FOREIGN PATENT DOCUMENTS

| | | | |
|---|---|---|---|
| 503890 | 9/1979 | Australia . | |
| 889320 | 1/1944 | France | 52/586.2 |
| 1537768 | 6/1967 | France . | |
| 1597611 | 6/1970 | France . | |
| 2667639 | 4/1992 | France | 52/592.2 |
| 2206858 | 8/1973 | Germany | 52/403.1 |
| 2534333 | 2/1977 | Germany | 52/403.1 |
| 295 08 540 U1 | 8/1996 | Germany . | |
| 4-49368 | 2/1992 | Japan | 52/480 |
| 6-57858 | 3/1994 | Japan | 52/586.2 |
| 178591 | 6/1922 | United Kingdom | 52/583.1 |

OTHER PUBLICATIONS

"Airthrust International, Inc. Pads", Action Floor Systems, Inc., Sweet's General Building & Renovation Catalog, 1995.

International Application Published Under the Patent Cooperation Treaty; Publication No. WO 96/27721; Publication Date: Sep. 12, 1996.

*Primary Examiner*—Carl D. Friedman
*Assistant Examiner*—Laura A. Callo
*Attorney, Agent, or Firm*—Trask, Britt & Rossa

[57] ABSTRACT

The flooring, preferably made in the form of modules which can be likened approximately to large tiles, is composed essentially of a tread layer comprising a core of high or medium density material (HDF or MDF) with a laminate layer, for example of melamine, applied to at least one of its faces, preferably to the lower face, as well as a plurality of support feet having selectively determined resilience characteristics, the spatial distribution of which in the plane of the flooring gives the flooring itself completely homogeneous mechanical characteristics.

45 Claims, 2 Drawing Sheets

LAMINATED FLOORING, FOR EXAMPLE FOR SPORTS FACILITIES, A SUPPORT FORMATION AND ANCHORING SYSTEMS THEREFOR

BACKGROUND OF THE INVENTION

The present invention relates to laminated floorings and has been developed with particular concern for its possible use in sports facilities; the invention should not, however, be considered as limited to this possible field of application.

In the field of sports flooring, installations for games such as basketball, volleyball and like sports are of particular importance, for which the characteristics of the flooring can be of considerable importance.

It may in fact be important that the flooring, in addition to having a uniform and regular surface appearance, has equally uniform and regular biomechanical properties, particularly with regard to vertical stresses applied by the athletes and by the equipment (for example balls) which move on the flooring.

For this reason, a conventional solution, which is much used for the formation of installations such as basketball courts, makes use of wooden flooring of the type usually termed parquet, usually made from an array of strips which rest on, and are fixed to the ground and which support an array of wooden strips, defining the flooring proper.

The characteristics of such floorings, in some countries, have even been the subject of specific technical standards. The standard DIN 18032 may be mentioned in this respect.

These conventional solutions have, however, a series of disadvantages.

A first disadvantage, which is considerable, is that they are very expensive, as well as being expensive to lay.

A further problem, which is equally important, is due to the fact that—at least in most cases—such wooden floorings do not lend themselves to installation in the open air whereby their use is in fact limited to closed environments.

A further problem is that the achievement of good biomechanical characteristics is linked preferentially to the formation of fixed installations. There is, however, an increasing demand for installations which can be laid on a site when needed but can then be removed when the same site is to be used for other purposes: this is the case, for example, for installations such as sports halls which, in addition to the sporting events themselves, are used for other types of entertainment such as concerts, conventions and social functions of various types, etc.

BRIEF SUMMARY OF THE INVENTION

The object of the present invention is to provide a flooring which is able to satisfy all of the above requirements in an excellent manner.

According to the present invention, this object is achieved by a laminated flooring having the characteristics claimed specifically in the claims which follow.

BRIEF DESCRIPTION OF THE SEVERAL VIEWS OF THE DRAWING

The invention will now be described purely by way of non-limitative example, with reference to the appended drawings, in which.

DETAILED DESCRIPTION OF THE INVENTION

Figure 1:
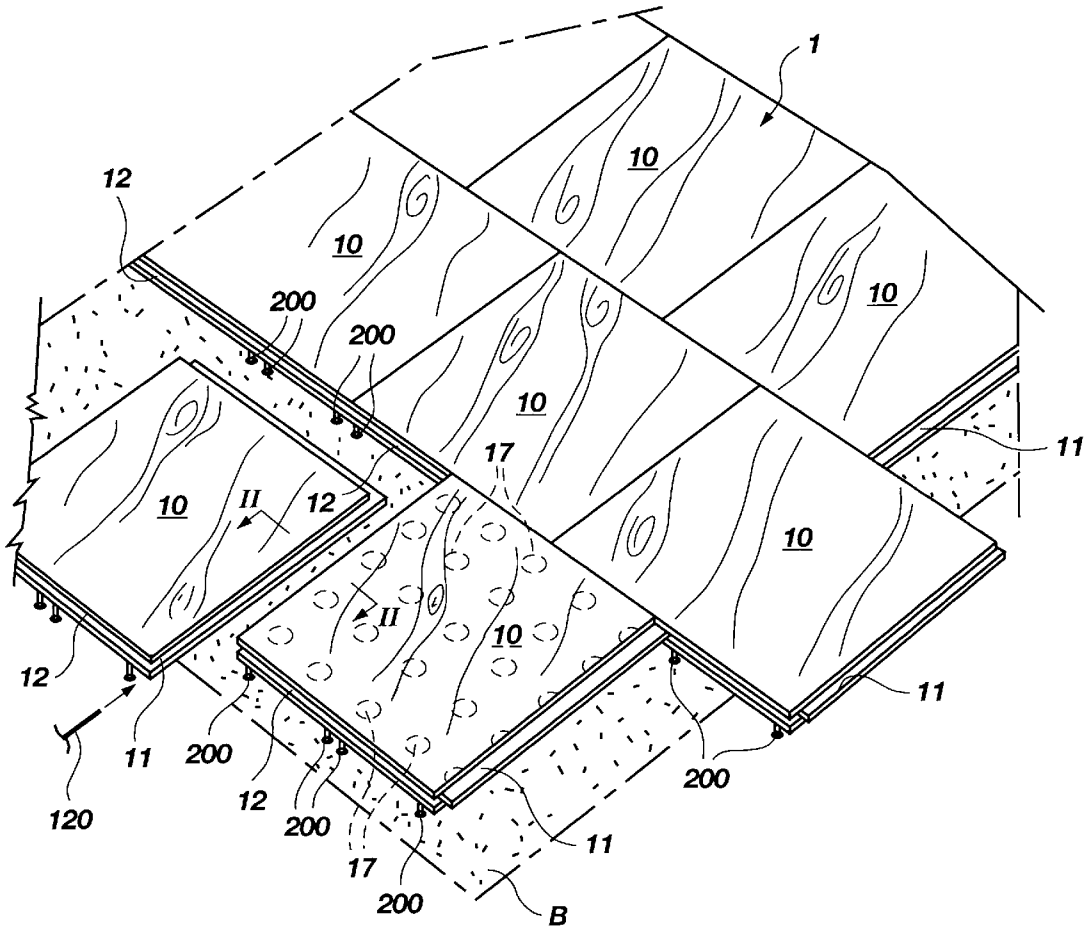
FIG. 1 illustrates schematically the manner in which the flooring of the invention is laid.

The flooring according to the invention, generally indicated 1, is preferably composed of a set of modules 10 each constituted, for example, by a sort of large tile (for example 1 meter×1 meter, these dimensions being indicative and not to be interpreted in a limitative sense) which can be assembled, preferably but not essentially, in staggered courses, the courses being staggered by half a tile as shown in FIG. 1. It should however be specified that the solution of the invention lends itself to being realized in the form of an essentially continuous flooring, of indefinite dimensions and/or of being constituted by modules other than tiles, for example as strip, plank or like modular elements. The modular structure facilitates the laying of the flooring 1 on a subfloor B such as, for example, a concrete screed or, possibly, a pre-existing floor of a different type (vinyl, linoleum flooring, etc.) to which the flooring of the invention may even be fixed.

An interesting characteristic of the invention lies in the fact that it provides the possibility of its being laid quickly on a particular site and then being removed with equal rapidity whenever the site is to be used for other purposes.

From the perspective view of FIG. 1 it can be appreciated that the flooring modules 10 are generally configured so as to form a male-female-type coupling.

For this purpose, each module 10, here shown as a generally square tile, has a projecting male formation 11 along two of its sides, and intended to engage in a corresponding female formation, constituted by a recess 12, formed on the opposing side of an adjacent module 10.

The coupling of adjacent modules 10 may be made firmer by the interposition of a profiled rod 120, typically a circular-section metal rod, as a fixing element. Both the choice of material and the section of the rod 120, are not, however, fixed for the purposes of carrying out the invention.

When this fixing solution is used, both the male formation 11 and the corresponding recess 12 (see in particular the section of FIG. 2) are provided with respective grooves 11*a*, 12*a* extending along their lengths. When two adjacent modules 10 are alongside each other in their coupled positions, the grooves 11*a*, 12*a* of the coupled elements 11, 12 are aligned with each other so as to form a cavity (of circular section in the example illustrated) in which the fixing rod 120 is inserted by longitudinal sliding. The presence of the rod 120 thus locks the male formation 11 within the complementary recess 12, fixing the adjacent modules 10 together. In a complementary manner, if the rod 120 is slid out of the cavity formed by the grooves 11*a*, 12*a*, the male formation 11 may be disengaged from the respective recess 12, allowing the two modules 10 to be separated.

In addition, or as an alternative (which is preferred according to experiments carried out by the Applicant) to the fixing system just described, the coupling of adjacent modules 10 may be consolidated by the provision of pin elements 200 on the lower face of the modules 10 themselves, which, when the flooring is laid, project towards the subfloor B. The elements 200, each usually constituted by the proximal portion of the shank of a screw screwed into the module 10, are located at the corners or sides of the modules 10 (for example at the corners or in the middle of the sides as shown schematically in FIG. 1).

The modules 10 in adjacent positions have thus elements 200 located facing each other. Coupling elements 202, usually of resilient type, may be engaged with these to hold adjacent modules 10 together.

Figure 3:
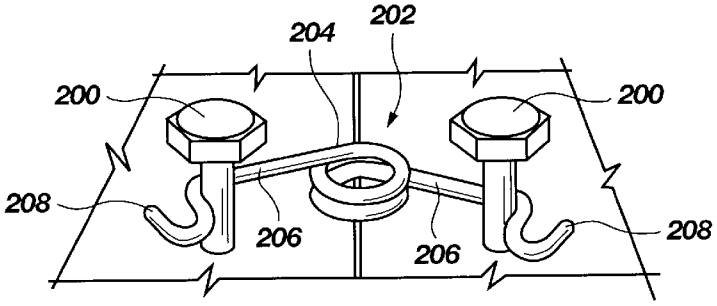
FIG. 3 illustrates in detail the structure of an element usable in the laying of flooring according to the invention.

Preferably the coupling elements 202 in question have the structure shown in FIG. 3, that is, a generally arcuate form with a central part 204 having the arcuate structure, or preferably a helical structure, from which branch, in approximately diametrally opposite positions, two arms 206 having respective hooked ends 208. The distance between the loops defined by the arms 206 with the respective hooks 208 corresponds approximately—but is rather smaller when the element 202 is in a rest condition—to the distance between two pin elements 200 intended to be connected together. The coupling element 202 may thus be snap-engaged so as to connect these pin elements 200, the central part 204 flexing slightly.

In each case, the male-female connection between adjacent modules 10 has proved to be particularly advantageous in the specific field of application, being preferable to coupling solutions with more or less partial superposition used in modular floorings known in the art.

More particularly, the coupling solution illustrated, in which the male formation 11 fits into the recess 12, has been shown to be very advantageous in that it enables adjacent modules 10 to be fixed very firmly together. This is true as much for the horizontal direction (that is the direction of movement apart of the adjacent modules 10, which is effectively opposed) as for the vertical direction at the edges of the adjacent modules 10. Consequently these modules behave as a single structure particularly with regard to vertical stresses, the continuity of the characteristics being made even more evident by the distribution of the support feet of which more will be said below.

Figure 2:
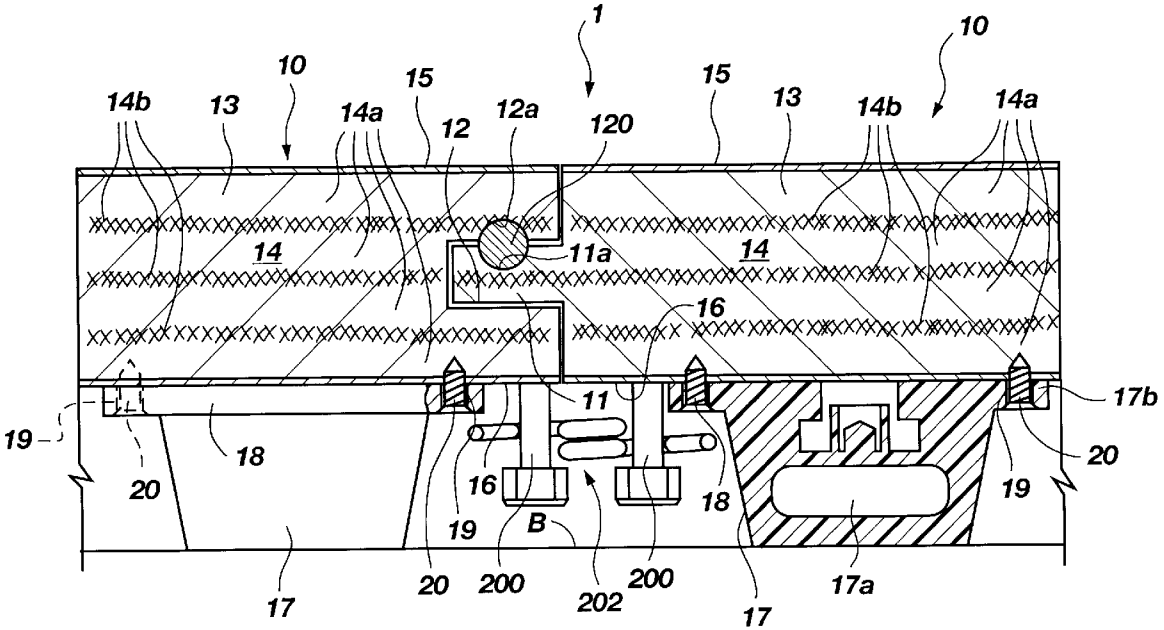
FIG. 2 is a vertical section corresponding approximately to the line II—II of FIG. 1, intended to illustrate the characteristics of the structure of the flooring of the invention in detail.

From the drawings, particularly from the sectional view of FIG. 2, it may be noted that the flooring 1 of the invention can be seen essentially as a laminated flooring with two components, that is to say:

- plate-like elements forming the bodies of the modules 10, made in the form of tiles, strips, etc. or even as a continuous layer, intended to form the tread layer proper of the flooring, indicated 13, and
- support elements preferably made in the form of resilient feet 17 intended to support the tread layer 13 on the subfloor B.

The tread layer 13 in turn has a laminar structure, being constituted mainly by a core 14 which carries respective coating layers on one or both of its opposite faces, that is, the upper and lower faces in the normal position of use of the flooring 1, these coatings being applied preferably by the usual techniques of hot gluing under pressure. These coatings are indicated 15 and 16 in the embodiment of FIG. 2.

The core portion 14 is made from a material of the type currently termed HDF (High Density Fibre) or MDF (Medium Density Fibre). These are materials in current use, particularly in the furniture industry, constituted essentially by fibres of wood origin aggregated with a binder matrix, typically with a ureic binder.

The technology for the production of HDF or MDF materials is well known in the art and does not require specific explanation here.

In a particularly preferred embodiment of the invention, it has been found that the choice of an MDF material having the characteristics given below is particularly advantageous:

| | |
|---|---|
| density: | 600–1000 kg/m$^3$, preferably about 800–850 kg/m$^3$ |
| formaldehyde content: | less than 9 mg per 100 g of material |
| moisture content: | 3–10%, preferably about 4% |
| internal bond: | 0.65N/mm$^2$ |
| bending strength: | 36N/mm$^2$ |
| elastic modulus: | 2400N/mm$^2$ |

This is particularly true with regard to satisfying the requirement of giving the tread layer 13 such a bending strength that, in practice, the tread layer 13 can be considered as an entirely rigid unit, which does not deform, or at least does not deform appreciably, under normal stresses of use. By normal conditions of use are understood, naturally, those typical for sports flooring or for social use. Specifically for sports flooring, the conditions in question are those corresponding to the stresses applied by athletes using the flooring and by equipment (for example balls) used by them.

The compliance and resilience characteristics of the flooring 1 as a whole are, however, defined and determined primarily by the compliance characteristics of the support formations represented here by the feet 17.

The MDF material forming the core 14 of the tread layer may be constituted by a single layer or by several layers 14*a* of MDF joined by adhesive layers 14*b*, for example of ureic type. The schematic drawing of FIG. 2 relates to an embodiment in which there are four layers 14*a*, each having a thickness of about 5 mm, separated by three layers 14*b*. In any case this solution should not be considered in itself as binding for the purposes of carrying out the invention since, at least for some applications, it would seem to be preferential to form the core 14 as a single layer of material. The final three data (internal bond, bending strength and elastic modulus) given above relate to each of the layers 14*a* and thus relate to a thickness of 5 mm. Clearly the data relating to the core 14 as a whole, having a thickness of about 2 cm, are correspondingly scaled, particularly when the core 14 has a uniform structure.

In the embodiment explained here, the layer 15, intended to form the upper face of the flooring which is exposed to wear, is preferably made from a laminate of the type currently called HPL (High Pressure Laminate), for example with a melamine base, preferably with the following characteristics, determined according to the EN 438 standard:

| | |
|---|---|
| abrasion resistance: | EN 438/6 -greater than 8000 revs |
| impact strength | EN 438/12 -from a height of more than 50 cm diameter less than 7 mm |
| stain resistance | EN 438/15 -higher than class 4 |
| light fastness | EN 438/16 -higher than grade 6 blue scale |
| resistance to cigarette burns | EN 438/18 -higher than class 3–4 |
| resistance to vapour | EN 438/24 -higher than class 4 |

This choice has the further advantage of associating with the high mechanical strength (including resistance to nicking, scratching, etc.) of such laminates, the possibility of giving the layer 15 itself (in accordance with widely known technology which does not need to be explained here) the external appearance of a flooring, for example of wood, with very faithful reproduction of the appearance of such flooring.

The choice of laminate material, for example of melamine type, for the layer 15 is, however, only one of the many possible solutions.

Valid alternatives, depending on applicational requirements, may, for example, be provided by layers of wood, vinylic material or rubber, of the type currently used for the manufacture of floorings, particularly sports floorings.

It is also possible to consider the manufacture of the tread layer 13 without the upper layer 15, thus leaving the final choice of the coating layer to be applied to the upper face of the flooring to the user.

Preferably the lower layer 16 is also constituted by a laminate, for example an HPL melamine laminate, the function of which is essentially to provide, together with the core 14, a tread layer 13 having a "balanced" structure, which is highly insensitive to warping (so-called bulging). In this respect it should be noted that, as already stated, the presence of the layer 15 is not in itself imperative.

When the layer 15 is present it is preferable for the layer 16 to have mechanical characteristics as close as possible to those of the upper layer 15. This choice has been shown to be preferential due to the fact that it gives the tread layer 13 as a whole completely symmetrical characteristics with regard to contractile stresses and surface extension of the layers 15 and 16.

As a whole, the tread layer 13 made in the manner described has the further advantage of being repellent to humidity and even to liquids such as water, exactly because of its very dense structure and the nature of its constituent materials.

This means that the flooring 1 of the invention is suitable even for use as flooring in the open.

The provision of support formations 17 in the form of feet 17, in the manner which will be described more fully below, is one of various possible choices (all of which fall within the scope of the invention however) including strips, various profiled formations, etc.

The use of elements in the form of feet, on the other hand, allows the compliance (resilience) characteristics of the individual support formation to be determined precisely. There is also the option of varying the spatial distribution of the support formations 17 within the general plane of development of the flooring 1 so as to enable any lack of uniformity induced by the modular structure of the tread layer 13 to be taken up completely.

With regard to the first aspect, a solution which has been shown to be particularly advantageous is the realization of support formations in the form of feet comprising a body, preferably in the form of a frusto-conical, hollow body, preferably with an upwardly divergent form and, still more preferably, with a peripheral flange 17*b* around the upper edge which gives the foot 17 a generally T-shape or mushroom-shape such that it has an enlarged head portion 18 intended to support the tread layer 13 by contact with the lower layer 16.

For clarity it should be noted that all the characteristics indicated above are highly advantageous but not, in themselves, essential for achieving the inventive purposes of the flooring.

As is better seen in the right-hand part of FIG. 2, each foot 17 is preferably made in the form of an at least partially hollow, closed body, and, hence, with its frusto-conical body having an inner cavity 17*a* which is closed and sealed by the head 18. This latter may be provided with holes 19 around its periphery which enable the foot 17 to be fixed to the lower face of the tread layer 13 by fixing elements such as bolts or screws 20. Naturally it is also possible to think of different types of connection, such as gluing or the use of clamps.

Feet 17 having the characteristics described above may be made, for example, by the technique currently termed rotational moulding, usually used for the manufacture of hollow plastics articles, for example balls, etc.

As shown schematically in broken outline in FIG. 1 with reference to only one of the modules 10, the availability of support formations such as the feet 17 also allows the spatial distribution of the feet 17 beneath the tread layer 13 to be selected, providing for example, for a very closely-spaced arrangement at the edges of the modules 10.

For the purposes of the present invention, a spatial distribution which has been found to be particularly advantageous, under each module 10 in a form of a square plate with dimensions of the order of 100×100 cm or 120×120 cm, comprises a regular array of feet 17 arranged in a square grid including an equal number of equispaced rows and columns, with the outer rows and columns, that is the closest rows and columns of the module 10, each situated at a distance from the respective lower edge equal to half the distance separating the said rows and said columns.

Naturally different spatial distributions are possible for specific applicational requirements, the scope it is intended to achieve remaining the same.

Naturally the laminate layer could be provided on only the upper face of the core 14.

Naturally the principle of the invention remaining the same, the constructional details and forms of embodiment may be varied widely with respect to that described and illustrated, without thereby departing from the scope of the present invention. This is true particularly with regard to the thickness of the core 14 of the tread layer, the thickness of which may vary within wide limits: the value currently preferred is in the range of about 15 mm to about 35 mm, preferably about 27 mm.

With regard to the feet 17, the choice of the following characteristics has been shown to be particularly advantageous:

| | |
|---|---|
| height: | from about 15 to about 45 mm, preferably about 30 mm; |
| diameter of the minor base: | from about 20 mm to about 60 mm, preferably about 40 mm; |
| diameter of the major base: | from about 45 mm to about 85 mm, preferably 65 mm; of these dimensions about 10 mm are attributable to the flange 17b; |
| constituent material: | all materials, such as polyolefins, which can be moulded by the rotational technique, preferably PVC and even more preferably, plasticized PVC. |

It should be noted that, at least in principle, the support formation constituted by each foot 17 may also be mounted the opposite way up from the condition illustrated in the drawings, that is with the minor base in contact with the tread layer 13 and the major base resting on the subfloor B.

What is claimed is:

1. Laminated flooring comprising:

a tread layer comprising a core having two faces, said core being fabricated of a material selected from the group constituted by HDF and MDF materials and having a first layer of laminate applied to one of said two faces of said core, and support formations which support the tread layer in use; each said support formation defining a hollow interior region which is closed and sealed by the body of the support formation itself; the tread layer being arranged as a substantially rigid structure in use;

whereby the characteristics of compliance of the flooring are determined essentially by the compliance characteristics of the support formations.

2. Flooring according to claim 1, wherein in the tread layer, the at least one laminate layer is applied to the core so as to adhere firmly thereto so as to form an overall structure which is essentially insensitive to warping deformations.

3. Flooring according to claim 1, wherein a second layer of laminate is applied on another face of said two faces of the core and said first layer of laminate and said second layer of laminate have mechanical characteristics substantially identical to each other whereby the tread layer as a whole is a balanced structure which is essentially insensitive to warping deformations.

4. Flooring according to claim 1, wherein the at least one laminate layer is a melamine laminate.

5. Flooring according to claim 1, wherein said first layer of laminate is applied to that face of the core which is uppermost in use, which layer of laminate has a surface appearance imitating wood.

6. Flooring according to claim 1, wherein the laminate layer is present on only that face of the core which is lowermost in use.

7. Flooring according to claim 1, wherein the said core in the said tread layer also has a laminated structure.

8. Flooring according to claim 1, wherein the said core is constituted by material including ureic binders.

9. Flooring according to claim 1, wherein the said core has a thickness of between about 15 mm and about 35 mm.

10. Flooring according to claim 1, wherein the said core has a density of about 600 to about 1000 kg/m$^3$.

11. Flooring according to claim 1, wherein the tread layer is made in the form of modules.

12. Flooring according to claim 11, wherein the modules are made in the form of tiles, strips, or planks.

13. Flooring according to claim 11, wherein the modules are connected together by male—female coupling.

14. Flooring according to claim 1, wherein the support formations are in the form of feet.

15. Flooring according to claim 1, wherein the said core has a thickness of 27 mm.

16. Flooring according to claim 1, wherein the said core has a density of from about 800 to about 850 kg/m$^3$.

17. Laminated flooring, comprising:

a tread layer comprising a core of a material selected from the group constituted by HDF and MDF materials and having a layer of laminate applied to at least one of its faces, and support formations which support the tread layer in use and wherein the support formations are distributed non-uniformly beneath the tread layer; the tread layer being arranged as a substantially rigid structure in use whereby the characteristics of compliance of the flooring are determined essentially by the compliance characteristics of the support formations.

18. Laminated flooring, comprising:

a tread layer comprising a core of a material selected from the group constituted by HDF and MDF materials and having a layer of laminate applied to at least one of its faces, the tread layer being made in the form of modules; and support formations which support the tread layer in use; said support formations being provided in greater density beneath the edge portions of the modules than beneath the remaining regions of the flooring; the tread layer being arranged as a substantially rigid structure in use whereby the characteristics of compliance of the flooring are determined essentially by the compliance characteristics of the support formations.

19. A support formation for flooring, said support formation comprising:

a resiliently compressible element having a first surface for engaging a bottom surface of said flooring and a second surface for engaging an underlying surface positioned elevationally below said flooring, said element defining a hollow, interior cavity which is closed and sealed by the body of the element itself.

20. A support formation according to claim 19 including at least one cavity closed to the exterior.

21. A support formation according to claim 20, characterized in that it is made from a material which is able to be rotationally moulded.

22. A support formation according to claim 19 having a frusto-conical shape.

23. A support formation according to claim 22, characterized in that it is made from a material which is able to be rotationally moulded.

24. A support formation according to claim 19 having an upwardly-diverging shape in use.

25. A support formation according to claim 24, characterized in that it is made from a material which is able to be rotationally moulded.

26. A support formation according to claim 19 having a T-shape or a mushroom-shape with a head portion surrounded by a peripheral flange.

27. A support formation according to claim 26, characterized in that it is made from a material which is able to be rotationally moulded.

28. A support formation according to claim 19, characterized in that it is made from a material which is able to be rotationally moulded.

29. A support formation according to claim 19 made from a material selected from the group constituted by: polyolefins, polyvinyl chloride and plasticised polyvinyl chloride.

30. A support formation according to claim 19 having a height of between about 15 mm and about 45 mm.

31. A support formation according to claim 19 having a height of about 30 mm.

32. A support formation according to claim 19 having a minor base with a diameter of between about 20 mm and about 60 mm.

33. A support formation according to claim 19 having a minor base with a diameter of about 40 mm.

34. A support formation according to claim 19 having a major base with a diameter of between about 45 mm and about 85 mm.

35. A support formation according to claim 19 having a major base with a diameter of about 65 mm.

36. A support formation according to claim 19 having a major base surrounded by a peripheral flange with a diametral dimension of about 10 mm.

37. An anchoring system in combination with laminated flooring, wherein said flooring includes a tread layer and support formations which support the tread layer in use, the tread layer being made in the form of modules connected together by generally male-female coupling configurations, the anchoring system comprising:

pin elements adapted for securement to the tread layer to project downwardly from the tread layer, and coupling elements for interconnecting pairs of pin elements on adjacent modules of the flooring.

38. A system according to claim 37, wherein the pin elements are defined by respective parts of fixing members inserted in the tread layer of the respective flooring module.

39. A system according to claim 37, wherein the pin elements are located in peripheral positions in the respective flooring module.

40. A system according to claim 39, wherein each of the pin elements is located in a position selected from a corner position and an intermediate edge position of the respective flooring module.

41. A system according to claim 37, wherein the coupling elements have a central part and two arms terminating with respective hook parts.

42. A system according to claim 41, wherein the central part is generally springy.

43. A system according to claim 42, wherein the central part is constituted by a filiform element wound into a helix.

44. A system according to claim 37, wherein the coupling elements have a generally arcuate shape.

45. A system according to claim 37, wherein the male-female configuration comprises:

a male formation projecting along at least one edge of a respective module and having a longitudinal groove, and a receiving recess for housing the male element of an adjacent module extending along a respective edge of a respective module and having a further longitudinal groove which, when two modules are brought into adjacent positions, is aligned with the longitudinal groove in the respective male element so as to define a cavity coextensive with the edges of the two adjacent modules, and a fixing element which can be inserted in the coextensive cavity to hold the two adjacent modules together in contact with each other.

* * * * *